US008833744B2

(12) United States Patent
Nemoto et al.

(10) Patent No.: US 8,833,744 B2
(45) Date of Patent: Sep. 16, 2014

(54) CONDENSER

(71) Applicants: Akira Nemoto, Tokyo (JP); Naoki Sugitani, Yokohama (JP); Yoshio Mochida, Ebina (JP)

(72) Inventors: Akira Nemoto, Tokyo (JP); Naoki Sugitani, Yokohama (JP); Yoshio Mochida, Ebina (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/719,346

(22) Filed: Dec. 19, 2012

(65) Prior Publication Data

US 2013/0118723 A1 May 16, 2013

Related U.S. Application Data

(63) Continuation of application No. 12/579,800, filed on Oct. 15, 2009, now abandoned, which is a continuation of application No. PCT/JP2008/072433, filed on Dec. 10, 2008.

(30) Foreign Application Priority Data

Dec. 10, 2007 (JP) ..... 2007-318632

(51) Int. Cl.

| | |
|---|---|
| ***B01F 3/04*** | (2006.01) |
| ***F28B 1/02*** | (2006.01) |
| ***F28B 7/00*** | (2006.01) |
| ***F28F 1/00*** | (2006.01) |
| ***F28B 9/08*** | (2006.01) |

(52) U.S. Cl.

CPC ... *F28F 1/00* (2013.01); *F28B 1/02* (2013.01); *F28B 7/00* (2013.01); *F28B 9/08* (2013.01); *Y10S 261/10* (2013.01); *Y10S 165/192* (2013.01)

USPC .... 261/146; 261/115; 261/157; 261/DIG. 10; 165/DIG. 192

(58) Field of Classification Search

CPC ..... F28B 1/00; F28B 1/02; F28B 7/00; F28B 9/08; F28B 9/10; Y10S 165/192; Y10S 261/10

USPC ..... 261/113, 115, 118, 127, 146, 147, 149, 261/157, DIG. 10, DIG. 76; 165/DIG. 192

See application file for complete search history.

(56) References Cited

U.S. PATENT DOCUMENTS

| | | | |
|---|---|---|---|
| 3,817,323 | A | 6/1974 | Ebara et al. |
| 3,834,133 | A | 9/1974 | Bow |

(Continued)

FOREIGN PATENT DOCUMENTS

| | | |
|---|---|---|
| EP | 0115865 | 8/1984 |
| EP | 1310756 | 5/2003 |

(Continued)

OTHER PUBLICATIONS

International Search Report for International Application No. PCT/JP2008/072433 (Mar. 17, 2009).

(Continued)

*Primary Examiner* — Charles Bushey

(74) *Attorney, Agent, or Firm* — Finnegan, Henderson, Farabow, Garrett & Dunner, LLP

(57) ABSTRACT

A condenser includes a high pressure side condenser, a high pressure side cooling tube bank, a high pressure side hot well, a low pressure side condenser, a low pressure side cooling tube bank, a pressure shroud provided inside the low pressure side condenser, a low pressure side hot well, high pressure steam introducing portion, low pressure side condensate introducing portion, a flash box which communicates with at least one of the high pressure side hot well and the low pressure side hot well, flashes a heater drain from a feed water heater, and urges at least one of the high pressure side hot well and the low pressure side hot well to recover the flashed heater drain, and a flash steam path which introduces flash steam generated inside the flash box into at least one of the high pressure side hot well and the low pressure side hot well.

28 Claims, 4 Drawing Sheets

(56) References Cited

U.S. PATENT DOCUMENTS

| | | | | |
|---|---|---|---|---|
| 4,288,393 | A | 9/1981 | Sekiguchi et al. | |
| 4,598,767 | A | 7/1986 | Saleh | |
| 5,083,606 | A | 1/1992 | Brown et al. | |
| 6,041,852 | A * | 3/2000 | Sato et al. | 165/114 |
| 6,095,238 | A * | 8/2000 | Kawano et al. | 165/113 |
| 6,814,345 | B2 | 11/2004 | Inoue | |
| 7,111,832 | B2 | 9/2006 | Inoue | |
| 2003/0090010 | A1 | 5/2003 | Inoue | |

FOREIGN PATENT DOCUMENTS

| | | |
|---|---|---|
| JP | 49-12482 | 3/1974 |
| JP | 49-32002 | 3/1974 |
| JP | 59-81972 | 6/1984 |
| JP | 59-175808 | 11/1984 |
| JP | 61-168787 | 7/1986 |
| JP | 63-210503 | 9/1988 |
| JP | 11-173768 | 7/1999 |
| JP | 2003-148876 | 5/2003 |
| JP | 3706571 | 8/2005 |

OTHER PUBLICATIONS

International Preliminary Report on Patentability for PCT/JP2008/072433, mailed Sep. 10, 2010.

Supplementary European Search Report issued for Application No. EP 08860801, mailed Apr. 15, 2014, 3 pages.

* cited by examiner

PRIOR ART

CONDENSER

CROSS REFERENCE TO RELATED APPLICATIONS

This is a continuation of application Ser. No. 12/579,800, filed Oct. 15, 2009, now abandoned, which is incorporated herein by reference.

This is a Continuation Application of PCT Application No. PCT/JP2008/072433, filed Dec. 10, 2008, which was published under PCT Article 21(2) in Japanese.

This application is based upon and claims the benefit of priority from prior Japanese Patent Application No. 2007-318632, filed Dec. 10, 2007, the entire contents of which are incorporated herein by reference.

BACKGROUND OF THE INVENTION

1. Field of the Invention

The present invention relates to a condenser condensing steam into condensate with cooling water.

2. Description of the Related Art

A condenser applied to, for example, a nuclear power plant or a thermal power plant, condenses turbine exhaust steam which has ended an expansion work by steam turbine, into condensate, with cooling water. The cooling water used in such a condenser is sea water or fresh water from a cooling tower. The cooling water is made to flow in a heat-transfer pipe arranged in the condenser to exchange heat with the exhaust steam introduced into the condenser and condense the turbine exhaust steam.

One of the types of condenser is a multistage pressure condenser which comprises a plurality of, i.e. two or three main body shells (i.e. a plurality of condensers) and in which pipes are serially arranged such that the cooling water pass through each of the main body shells at a plurality of times. In the main body shell of the multistage pressure condenser which is arranged on a slip stream side of the flow path of the cooling water, vacuum in the main body shell becomes lower due to rise of cooling water temperature. For this reason, the pressure of the turbine exhaust steam introduced into the main body shell arranged at the slip stream side of the flow path of the cooling water becomes higher.

Temperature of the condensate condensed in the condenser becomes a saturation temperature which substantially corresponds to the turbine exhaust pressure introduced into the main body shell of the condenser. Thus, in the multistage pressure condenser in which the main body shells are different in pressure, condensate temperatures of the multistage pressure condenser having, for example, three types of pressures in the main body shells are higher in order of a high pressure condenser, an intermediate pressure condenser and a low pressure condenser.

Since the condensate generated in the condenser is supplied again to the system as feed water, a higher temperature of the condensate is desirable in terms of heat efficiency. In the above-described three-shell multistage pressure condenser, it is preferable to make the condensate of a comparatively low temperature generated in the intermediate pressure condenser and the low pressure condenser close to the condensate temperature in the high pressure condenser.

FIG. 4A is a front sectional view showing a structure of a conventional multistage condenser 100. FIG. 4B is a side sectional view showing the structure of the conventional multistage condenser 100.

The multistage condenser 100 is constituted by connecting a high pressure condenser 1, an intermediate pressure condenser 2 and a low pressure condenser 3 which are different in inner pressure, serially in this order.

The high pressure condenser 1 has a high pressure turbine 81 mounted on a head side, and a high pressure cooling tube bank 8 constituted by a number of heat-transfer pipes is provided inside the condenser. At a bottom portion of the high pressure condenser 1, a high pressure hot well 6 is provided and a condensate outlet box 7 is also provided at a lower side.

The high pressure hot well 6 consists of a liquid phase part 6*a* serving as the bottom portion where the condensate is stored, and a vapor phase part 6*b* provided between the liquid phase part 6*a* and the high pressure cooling tube bank 8. In addition, a heater drain tube 13 is connected to the high pressure condenser 1 and a high pressure baffle 9 is provided at the connection part.

The intermediate pressure condenser 2 has a lower inner pressure than the high pressure condenser 1, and has an intermediate pressure turbine 82 mounted on a head side. An intermediate pressure cooling tube bank 28 constituted by a number of heat-transfer pipes is provided inside the condenser, similarly to the high pressure condenser 1. A reheat chamber 22 partitioned by a pressure shroud 4 is provided at a lower portion of the intermediate pressure cooling tube bank 28.

In the reheat chamber 22, a steam duct 10 serving as high pressure steam introducing means, connected to the high pressure condenser 1, is provided. At a bottom portion of the intermediate pressure condenser 2, an intermediate pressure hot well 26 is provided. The intermediate pressure hot well 26 consists of a liquid phase part 26*a* serving as a bottom portion where the condensate is stored, and a vapor phase part 26*b* provided above the liquid phase part 26*a*. The vapor phase part 26*b* is the reheat chamber 22. The liquid phase part 6*a* of the high pressure hot well 6 and the liquid phase part 26*a* of the intermediate pressure hot well 26 communicate with each other by a condensate tube 11.

The low pressure condenser 3 has a lower inner pressure than the intermediate pressure condenser 2, and has a low pressure turbine 83 mounted on a head side. A low pressure cooling tube bank 38 constituted by a number of heat-transfer pipes is provided inside the condenser, similarly to the high pressure condenser 1 and the intermediate pressure condenser 2. A reheat chamber 23 partitioned by a pressure shroud 5 is provided at a lower portion of the low pressure cooling tube bank 38.

In the reheat chamber 23, a steam duct 30 serving as high pressure steam introducing means is provided and connected to the reheat chamber 22 of the intermediate pressure condenser 2. At a bottom portion of the low pressure condenser 3, a low pressure hot well 36 is provided. The low pressure hot well 36 consists of a liquid phase part 36*a* serving as a bottom portion where the condensate is stored, and a vapor phase part 36*b* provided above the liquid phase part 36*a*. The vapor phase part 36*b* is the reheat chamber 23. The liquid phase part 26*a* of the intermediate pressure hot well 26 and the liquid phase part 36*a* of the low pressure hot well 36 communicate with each other by a condensate tube 31. Furthermore, the heater drain tube 13 is connected to the low pressure condenser 3, and a low pressure baffle 39 is provided at the connection part.

As cooling water, for example, sea water is introduced into each of the high pressure cooling tube bank 8, the intermediate pressure cooling tube bank 28 and the low pressure cooling tube bank 38. In the multistage pressure condenser, the high pressure cooling tube bank 8, the intermediate pressure cooling tube bank 28 and the low pressure cooling tube bank 38 are connected serially. The cooling water is first introduced into the low pressure cooling tube bank 38, passes through the intermediate pressure cooling tube bank 28 after passing through the low pressure cooling tube bank 38, and is finally introduced intro high pressure cooling tube bank 8 and discharged.

In the high pressure cooling tube bank 8, the high pressure turbine exhaust which finishes the work at the high pressure turbine 81 and is supplied to the high pressure condenser 1 is condensed as a high pressure condensate by exchanging heat via the heat-transfer pipes with the cooling water of the highest temperature introduced into the high pressure cooling tube bank 8, and is recovered in the liquid phase part 6*a* of the high pressure hot well 6 of the high pressure condenser 1.

In the intermediate pressure cooling tube bank 28, the intermediate pressure turbine exhaust which finishes the work at the intermediate pressure turbine 82 and is supplied to the intermediate pressure condenser 2 is condensed as an intermediate pressure condensate by exchanging heat via the heat-transfer pipes with the cooling water passing through the intermediate pressure cooling tube bank 28. The intermediate pressure condensate is temporarily stored on the pressure shroud 4 of the intermediate pressure condenser 2 and then sprayed into the reheat chamber 22 through a number of circle holes formed on a perforated panel provided on the pressure shroud 4. The high pressure steam is introduced into the reheat chamber 22 from the vapor phase part 6*b* of the high pressure hot well 6 provided in the high pressure condenser 1 via the steam duct 10. The intermediate pressure condensate sprayed into the reheat chamber 22 by the high pressure steam is directly reheated by the heat exchange. The reheated intermediate condensate is finally stored in the liquid phase part 26*a* of the intermediate pressure hot well 26, supplied to the liquid phase part 6*a* of the high pressure hot well 6 via the condensate tube 11, and supplied to a feed water heater (not shown) through a condensate outlet box 7.

In the low pressure cooling tube bank 38, the low pressure turbine exhaust which finishes the work at the low pressure turbine 83 and is supplied to the low pressure condenser 3 is condensed as a low pressure condensate by exchanging heat via the heat-transfer pipes with the cooling water of the lowest temperature passing through the low pressure cooling tube bank 38. The low pressure condensate is temporarily stored on the pressure shroud 5 of the low pressure condenser 3 and then sprayed into the reheat chamber 23 through a number of circle holes formed on a perforated panel provided on the pressure shroud 5. The high pressure steam in the vapor phase part 6*b* of the high pressure hot well 6 is further introduced into the reheat chamber 23 from the reheat chamber 22 serving as the vapor phase part 26*b* of the intermediate pressure hot well 26 via the steam duct 30. The low pressure condensate sprayed into the reheat chamber 23 by the high pressure steam is directly reheated by the heat exchange. The reheated low condensate is finally stored in the liquid phase part 36*a* of the low pressure hot well 36, supplied to the liquid phase part 6*a* of the high pressure hot well 6 via the condensate tube 31, the liquid phase part 26*a* of the intermediate pressure hot well 26 and the condensate tube 11, and supplied to a feed water heater (not shown) through the condensate outlet box 7.

A heater drain generated by condensing in the feed water heater bleed steam of the steam turbine for reheating the feed water flows into the heater drain tube 13. The flowing heater drain, which is recovered in the high pressure condenser 1 or the low pressure condenser 3, collides with the high pressure baffle 9 or the low pressure baffle 39, reduces the flow force and falls into the liquid phase part 6*a* of the high pressure hot well 6 or the liquid phase part 36*a* of the low pressure hot well 36.

As for a known condenser, for example, Jpn. Pat. Appln. KOKAI Publication No. 11-173768, Jpn. U.M. Appln. KOKOKU Publication No. 49-12482, Japanese Patent No. 3706571, Jpn. Pat. Appln. KOKAI Publication No. 49-032002 and the like should be referred to.

BRIEF SUMMARY OF THE INVENTION

Problem to be Solved by the Invention

The temperature of the heater drain recovered in the condenser is higher than the saturation temperature in the condenser, and oxygen is often dissolved in the heater drain at a high concentration. In some cases, 40% or more of the entire fluid flowing in the condenser is the heater drain. For this reason, the temperature of the heater drain and oxygen dissolved in the heater drain give great influences to the performance and operation of the heater and plant.

When the heater drain collides with the baffle and falls similarly to the prior art, oxygen dissolved in the heater drain does not completely discharge but falls into the hot well, which results in increasing the concentration of oxygen dissolved in the condensate or greatly waving the liquid surface in accordance with the fall into the hot well.

If a large quantity of oxygen is dissolved in the condensate, the constituent elements of the power plant are corroded due to the chemical reaction and the like. The oxygen dissolved in the condensate therefore needs to be maintained at a low concentration at any time during the operation of the plant.

The present invention has been accomplished under those circumstances. The object of the present invention is to obtain a condenser capable of reducing oxygen dissolved in the heater drain recovered in the condenser.

Means for Solving the Problem

A condenser according to one aspect of the present invention comprises: a high pressure side condenser; a high pressure side cooling tube bank provided inside the high pressure side condenser, which has a high pressure side cooling water introduced therein and condenses a high pressure side turbine exhaust by heat exchange with the high pressure side cooling water to obtain a high pressure side condensate; a high pressure side hot well provided at a bottom portion of the high pressure side condenser; a low pressure side condenser which has an inner pressure lower than the high pressure side condenser; a low pressure side cooling tube bank provided inside the low pressure side condenser, which has a low pressure side cooling water introduced therein and condenses a low pressure side turbine exhaust by heat exchange with the low pressure side cooling water to obtain a low pressure side condensate; a pressure shroud provided at a lower part than the low pressure side cooling tube bank, inside the low pressure side condenser; a low pressure side hot well provided at a lower part of the pressure shroud, of the low pressure side condenser; high pressure steam introducing means provided at the low pressure side hot well, for communicating with an inner side of the high pressure side condenser and introducing high pressure steam; low pressure side condensate introducing means provided at the pressure shroud, for introducing a low pressure side condensate into the low pressure side hot well; a flash box which communicates with at least one of the high pressure side hot well and the low pressure side hot well, flashes a heater drain from a feed water heater, and urges at least one of the high pressure side hot well and the low pressure side hot well to recover the flashed heater drain; and a flash steam path which introduces flash steam generated inside the flash box into at least one of an interval between the high pressure side cooling tube bank and the high pressure side hot well and an interval between the low pressure side cooling tube bank and the low pressure side hot well.

DETAILED DESCRIPTION OF THE INVENTION

Embodiments of the present invention are explained below with reference to the accompanying drawings.

1st Embodiment

Figure 1A:
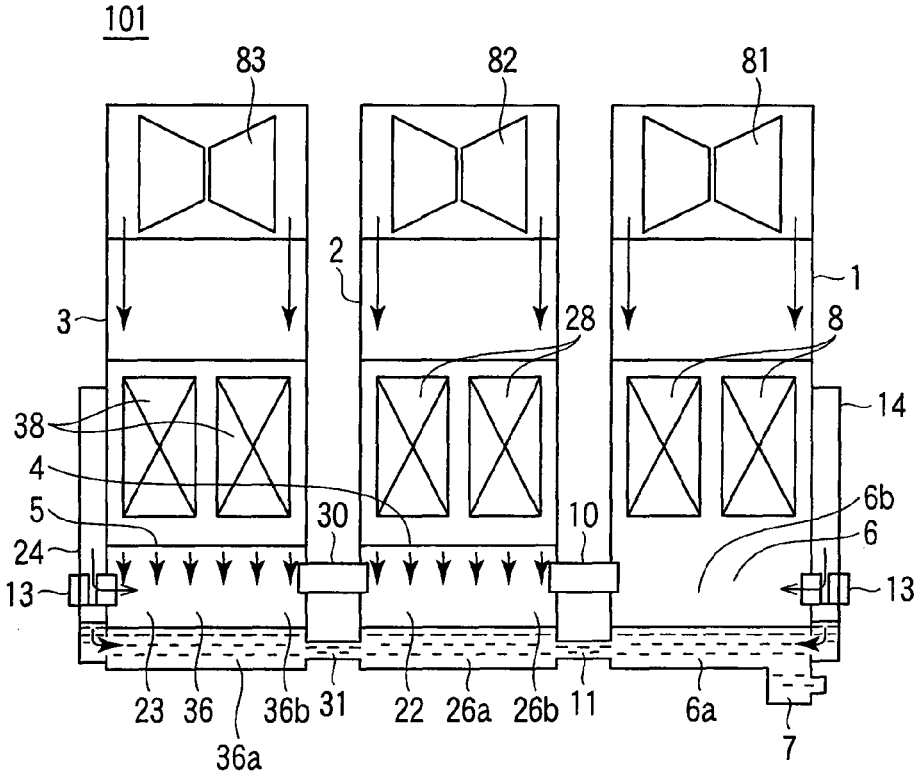
FIG. 1A is a front sectional view showing a structure of a multistage condenser according to the first embodiment of the present invention.
Figure 1B:
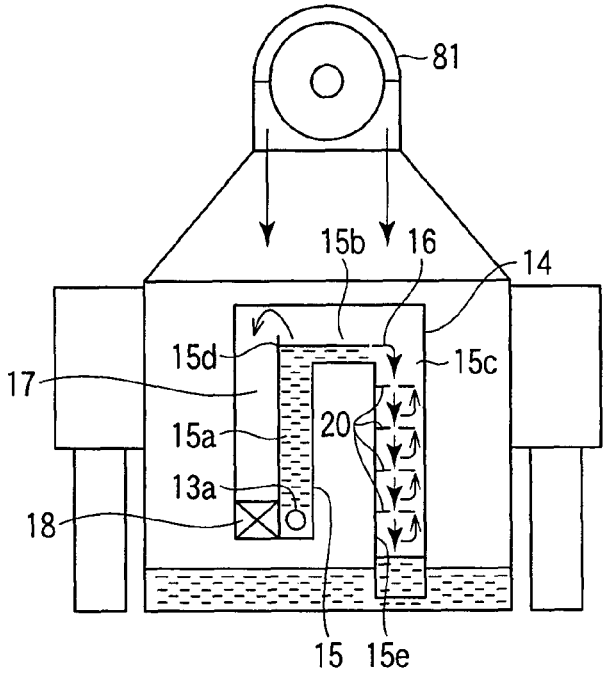
FIG. 1B is a side sectional view showing the structure of the multistage condenser according to the first embodiment of the present invention.

FIG. 1A is a front sectional view showing a structure of a multistage condenser 101 according to the first embodiment of the present invention. FIG. 1B is a side sectional view showing the structure of the multistage condenser 101 according to the first embodiment.

Figure 4A:
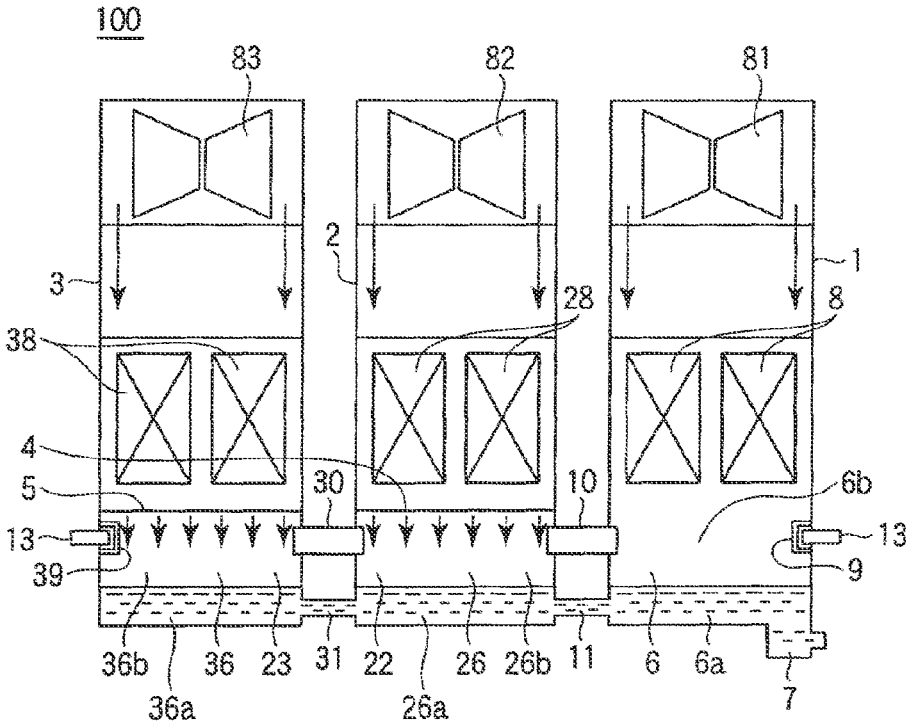
F I G. 4A PRIOR ART
FIG. 4A is a front sectional view showing a structure of a multistage condenser according to the prior art.
Figure 4B:
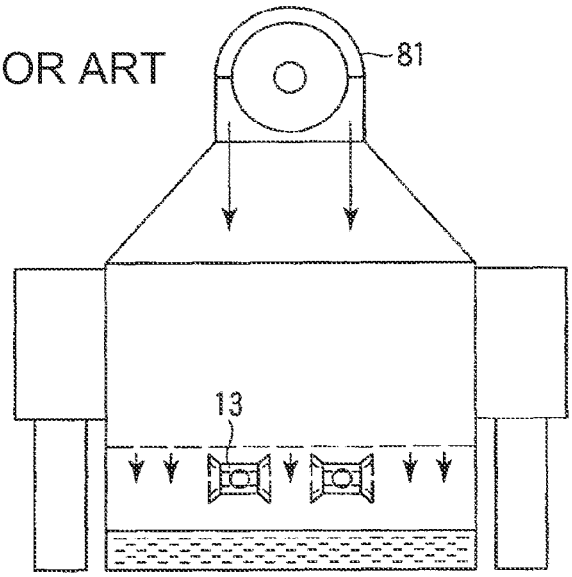
FIG. 4B is a side sectional view showing the structure of the multistage condenser according to the prior art.

In FIG. 1A and FIG. 1B, the same constituent elements as those of the prior art shown in FIG. 4A and FIG. 4B are denoted by the same reference numbers as those in FIG. 4A and FIG. 4B and their detailed explanations are omitted.

In the conventional multistage condenser shown in FIG. 4A and FIG. 4B, the high pressure baffle 9 is provided at the connection part between the heater drain tube 13 and the high pressure condenser 1, and the low pressure baffle 39 is provided at the connection part between the heater drain tube 13 and the low pressure condenser 3. In the multistage condenser 101 according to the present embodiment, however, the high pressure baffle 9 or the low pressure baffle 39 is not provided, but a high pressure flash box 14 is provided on an outside surface of the high pressure condenser 1 and a low pressure flash box 24 is provided on an outside surface of the low pressure condenser 3.

A heater drain path 15 formed in a reverse concave shape is provided in the high pressure flash box 14 provided on the outside surface of the high pressure condenser 1. One of lower parts of the heater drain path 15 formed in the reverse concave shape is partitioned into a drain channel part 15*a* and a flash steam path 17 adjacent thereto by a partition plate 15*d*. At a lower part of the drain channel part 15*a* partitioned by the partition plate 15*d*, a connection port 13*a* urging the heater drain from the heater drain tube 13 to be introduced into the flash box 14 is provided. An upper part of the flash steam path 17 communicates with the drain channel part 15*a*. At a lower part of the flash steam path 17, an equalizing port 18 communicating with the vapor phase part 6*b* of the hot well 6 of the high pressure condenser 1 is provided. The partition plate 15*d* partitioning the drain channel part 15*a* and the flash steam path 17 is set to be high such that the heater drain supplied in the drain channel part 15*a* does not flow into the flash steam path 17 over the partition plate 15*d*.

A lower end portion of the other lower part of the heater drain path 15 formed in a reverse concave shape is a drain fall part 15*c* which communicates with the liquid phase part 6*a* of the high pressure hot well 6. The drain fall part 15*c* is adjacent to the drain channel part 15*a* and a partition plate 15*e* is provided therebetween. The partition plate 15*e* is set to be lower than the partition plate 15*d* such that the heater drain introduced from the connection port 13*a* into the drain channel part 15*a* flows from the drain channel part 15*a* into the drain fall part 15*c*. Furthermore, porous plates 20 are provided at a plurality of steps inside the drain fall part 15*c*. In addition, a horizontal portion is provided on the drain channel part 15*a* on the side of the partition plate 15*e*, and this portion forms a free liquid level part 15*b*.

In other words, in the present embodiment, the heater drain path 15 formed in the flash box 14 is constituted by three parts, i.e., the drain channel part 15*a*, the drain fall part 15*c* and the flash steam path 17.

The heater drain introduced into the high pressure flash box 14 flows into the drain channel part 15*a* and is boiled at, particularly, the free liquid level part 15*b* to release flash steam. After that, heater drain 16 flows down in the drain fall part 15*c* over the partition plate 15*e*, becomes a liquid column at the porous plates 20 arranged at a plurality of steps in the drain fall part 15*c*, and increases an area of contact with the steam. At this time, the heater drain 16 falls while releasing the non-flashed steam, releases uncondensed gas such as oxygen dissolved in the heater drain 16, and deaerated. The deaerated heater drain 16 joins the condensate stored in the liquid phase part 6*a* of the high pressure hot well 6 from a bottom portion of the drain fall part 15*c*. The flash steam and uncondensed gas generated from the heater drain 16 are introduced into the flash steam path 17 over the partition plate 15*d* from an upper part of the drain channel part 15*a* to flow into the vapor phase part 6*b* of the hot well 6 (between the high pressure cooling tube bank 8 and the high pressure hot well 6) from the equalizing port 18 provided at the lower end of the flash steam path 17.

In the present embodiment, the low pressure flash box 24 is further provided on the side surface of the low pressure condenser 3. The heater drain path 15 is constituted by the drain channel part 15*a*, the drain fall part 15*c* and the flash steam path 17, similarly to the high pressure flash box 14, and the low pressure flash box 24 acts similarly. The steam and the uncondensed gas flowing through the flash steam path 17 of the low pressure flash box 24 are introduced into the vapor phase part 36*b* of the hot well 36 of the low pressure condenser 3 (between the low pressure cooling tube bank 38 and the low pressure hot well 36), i.e., into the reheat chamber 23 from the equalizing port 18. In the multistage condenser, as described above, the high pressure hot well 6, the intermediate pressure hot well 26 and the low pressure hot well 36 act similarly since they communicate with each other at the vapor phase part by the steam tubes 10 and 15 and at the liquid phase part by the condensate tubes 11 and 16.

Thus, according to the present embodiment, the heater drain 16 can be recovered in the multistage condenser 101 after the uncondensed gas such as dissolved oxygen is reduced sufficiently.

In addition, since the flash steam generated in the high pressure flash box 14 and the low pressure flash box 24 according to the present embodiment is introduced into the multistage condenser 101 via the flash steam path 17, the flash steam can be used to reheat the condensate flowing down from the pressure shroud 4 and the pressure shroud 5 and the heat efficiency can be thereby enhanced.

Furthermore, the high pressure flash box 14 and the low pressure flash box 24 according to the present embodiment maintain wide space for boiling the heater drain 16 by forming the free liquid level part 15*b* having a wide surface area at the drain path part 15*a* in the heater drain path 15, and can efficiently perform flashing and promote deaeration. In addition, by forming the free liquid level part 15*b*, the liquid level inside the drain tank connected to the heater drain system can also be controlled to be at a predetermined height.

$2^{nd}$ Embodiment

Figure 2A:
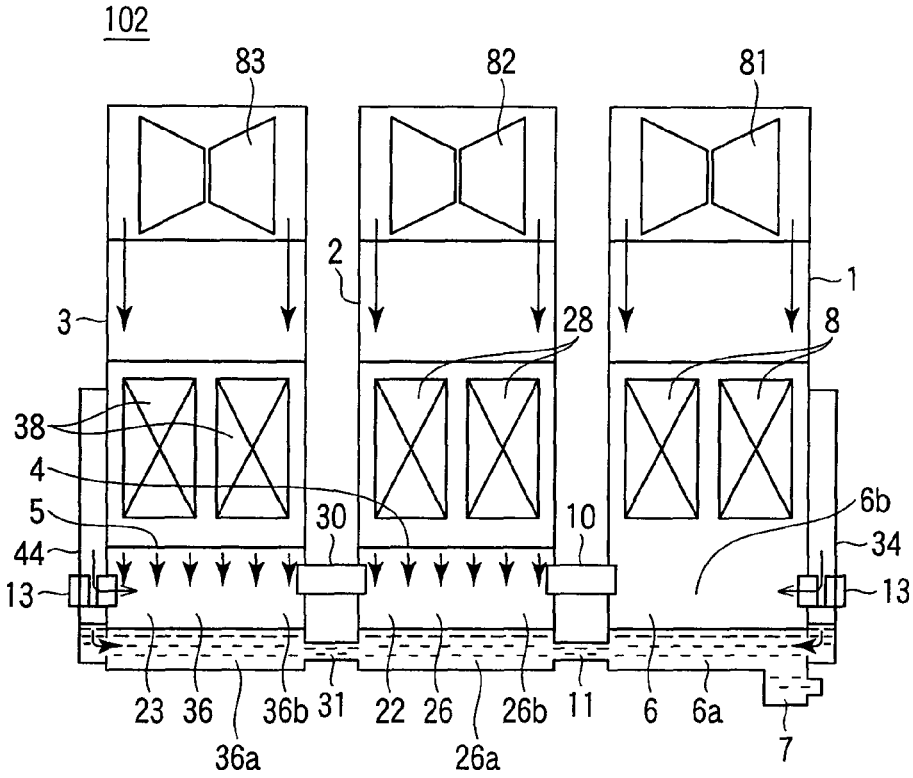
FIG. 2A is a front sectional view showing a structure of a multistage condenser according to the second embodiment of the present invention.
Figure 2B:
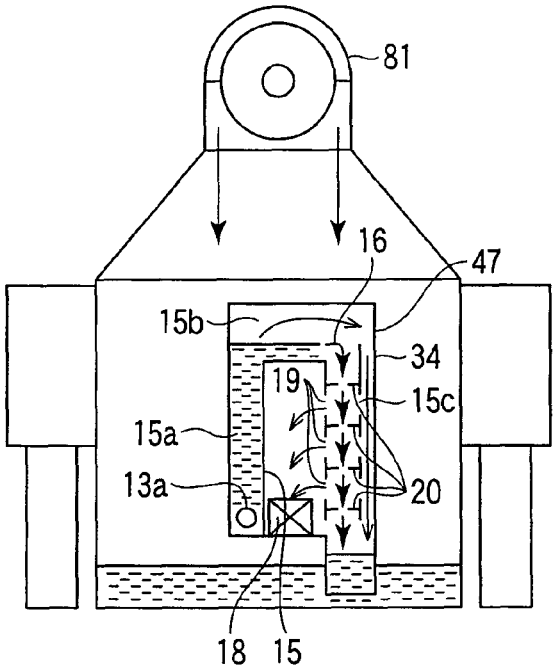
FIG. 2B is a side sectional view showing the structure of the multistage condenser according to the second embodiment of the present invention.

FIG. 2A is a front sectional view showing a structure of a multistage condenser 102 according to the second embodiment of the present invention. FIG. 2B is a side sectional view showing the structure of the multistage condenser 102 according to the second embodiment.

The same constituent elements as those of the first embodiment shown in FIG. 1A and FIG. 1B are denoted by the same reference numbers as those in FIG. 1A and FIG. 1B and their detailed explanations are omitted.

The flash steam path 17 is provided adjacent to the drain channel part 15*a* of the heater drain path 15 via the partition plate 15*d* in FIG. 1A and FIG. 1B. In a high pressure flash box 34 and a low pressure flash box 44 of the multistage condenser 102 according to the present embodiment, a flash steam path 47 is arranged adjacent to the drain fall part 15*c*, at a lower part of the free liquid level part 15*b* of the drain channel part 15*a*. Steam outlets 19 for supplying flash steam into the flash steam path 47 are provided on a wall surface of the drain fall part 15*c* which faces the flash steam path 47.

In this structure, the flash steam generated from the drain fall part 15*c* passes through the steam outlets 19 and is supplied to the flash steam path 47 after contacting the heater drain 16 falling down from the porous plates 20.

Since the falling heater drain 16 and the steam can thereby contact easily, deaeration of the uncondensed gas such as dissolved oxygen in the heater drain 16 can be promoted, the heater drain 16 can be recovered in the multistage condenser 102 after performing the deaeration sufficiently, and the same advantage as that of the first embodiment can be obtained.

In addition, the heater drain path 15 formed in each of the high pressure flash box 34 and the low pressure flash box 44 according to the present embodiment, is in an approximately rectangular shape, and can be downsized as compared with the high pressure flash box 14 and the low pressure flash box 24 according to the first embodiment.

$3^{rd}$ Embodiment

Figure 3A:
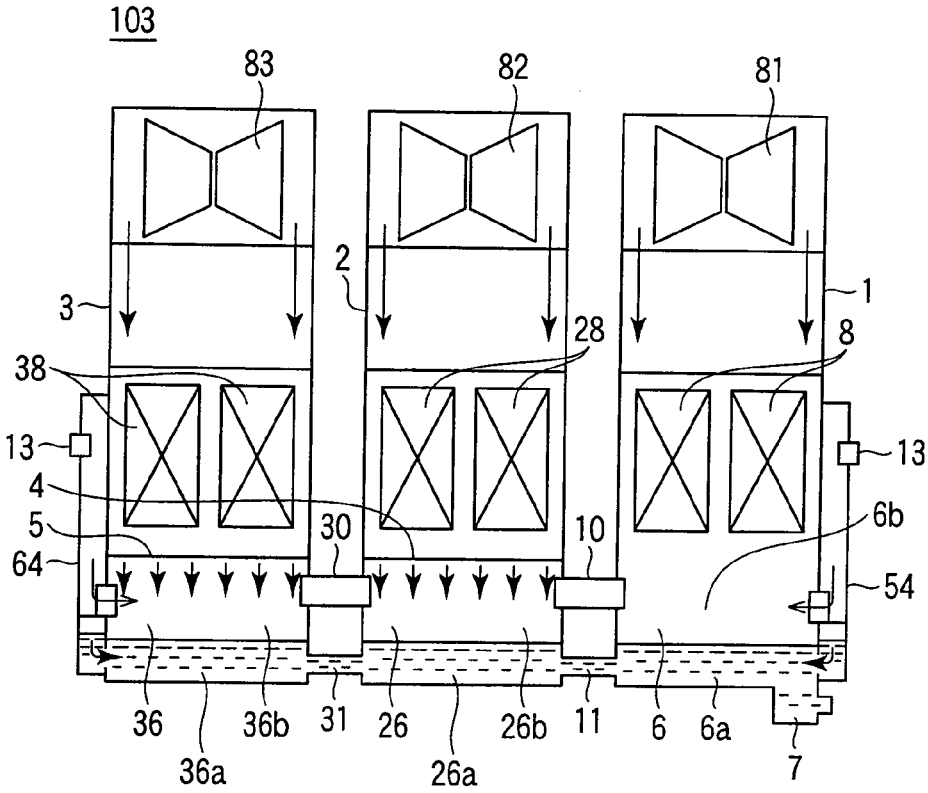
FIG. 3A is a front sectional view showing a structure of a multistage condenser according to the third embodiment of the present invention.
Figure 3B:
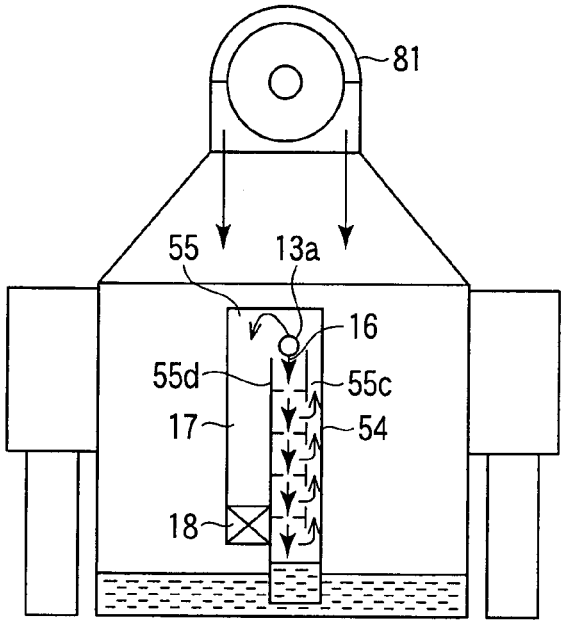
FIG. 3B is a side sectional view showing the structure of the multistage condenser according to the third embodiment of the present invention.

FIG. 3A is a front sectional view showing a structure of a multistage condenser 103 according to the third embodiment of the present invention. FIG. 3B is a side sectional view showing the structure of the multistage condenser 103 according to the third embodiment.

The same constituent elements as those of the first embodiment shown in FIG. 1A and FIG. 1B are denoted by the same reference numbers as those in FIG. 1A and FIG. 1B and their detailed explanations are omitted.

The heater drain path 15 is formed in the reverse concave shape in FIG. 1A and FIG. 1B. In a high pressure flash box 54 and a low pressure flash box 64 of the multistage condenser 103 according to the present embodiment, a heater drain path 55 is formed in a shape of approximately rectangular parallelepiped, and the heater drain path 55 shaped in an approximately rectangular parallelepiped is partitioned into a drain fall part 55*c* and the flash steam path 17 by a partition plate 55*d*. The heater drain path 55 according to the present embodiment does not have a drain channel part or a free liquid level part, but is constituted by the only drain fall part 55*c* and flash steam path 17. The connection port 13*a* for introducing the heater drain into the flash box 54 is provided at an upper end of the drain fall part 55*c* and, and a lower end of the drain fall part 55*c* communicates with the liquid phase part 6*a* of the high pressure hot well 6. The porous plates 20 are provided at a plurality of steps in the drain fall part 55*c*, similarly to the first and second embodiments.

The heater drain 16 becomes a liquid column at the porous plates 20 arranged at a plurality of steps in the drain fall part 55*c*, increases an area of contact with the steam, falls down while releasing the flash steam, releases uncondensed gas such as oxygen dissolved in the heater drain 16, and is thereby deaerated.

Thus, in the present embodiment, too, the heater drain 16 can be recovered in the multistage condenser 103 after sufficiently reducing the uncondensed gas such as dissolved oxygen and the like, similarly to the first and second embodiments.

In addition, since the flash steam generated in the high pressure flash box 54 and the low pressure flash box 64 is introduced into the multistage condenser 103 via the flash steam path 17, the flash steam can be used to reheat the condensate flowing down from the pressure shroud 4 and the pressure shroud 5 and the heat efficiency can be thereby enhanced.

Moreover, in the present invention, since the heat drain path 55 is constituted by the only drain fall part 55*c* and the flash steam path 17, the high pressure flash box 54 and the low pressure flash box 64 can be further downsized.

In the present embodiment, too, the steam outlets 19 may be provided on the drain fall part 55*c* to urge the falling heater drain 16 to contact a more quantity of the flash steam, similarly to the second embodiment shown in FIG. 2A and FIG. 2B.

In the first to third embodiments, the multistage condenser having the high pressure condenser, the intermediate pressure condenser, and the low pressure condenser combined is described. However, the present invention can be applied to all of multistage condensers having a plurality of condensers of different pressures combined, such as a multistage condenser having a high pressure condenser and a low pressure condenser combined, and the like.

In those embodiments, the flash box is provided on each of the high pressure condenser and the low pressure condenser. However, the flash box may be provided on all or one of condensers, for example, of some of condensers such as a high pressure condenser, an intermediate pressure condenser and a low pressure condenser. In addition, one of the flash boxes according to the first to third embodiments can be arranged on the high pressure condenser and one of the others can be arranged on the low pressure condenser. The flash boxes can be applied in combination.

Furthermore, in those embodiments, the flash boxes are provided on the outside surfaces of the condensers, but may be provided on any parts of the entry side of the heater drain into the condensers, such as the inner side surfaces of the condensers, or separately from the condensers.

In addition, the multistage condenser is exemplified in the above-described embodiments, but the present invention is not limited to this, but can also be applied to a single-pressure condenser (condenser constituted by one shell). In a case where any one of the flash boxes described in the first to third embodiments is provided on a condenser of a single turbine, the heater drain introduced into the condenser can be separated into the vapor phase and the liquid phase and dissolved oxygen in the heater drain can be reduced.

The present invention can provide a condenser capable of separating a heater drain introduced therein into a vapor phase and a liquid phase and reducing oxygen dissolved in the heater drain.

What is claimed is:

1. A condenser comprising:

a high pressure side condenser;

a high pressure side cooling tube bank provided inside the high pressure side condenser, which has high pressure side cooling water introduced therein and condenses high pressure side turbine exhaust by heat exchange with the high pressure side cooling water to obtain high pressure side condensate;

a high pressure side hot well provided at a bottom portion of the high pressure side condenser;

a low pressure side condenser which has an inner pressure lower than the high pressure side condenser;

a low pressure side cooling tube bank provided inside the low pressure side condenser, which has low pressure side cooling water introduced therein and condenses low pressure side turbine exhaust by heat exchange with the low pressure side cooling water to obtain low pressure side condensate;

a pressure shroud provided at a lower part than the low pressure side cooling tube bank, inside the low pressure side condenser;

a low pressure side hot well provided at a lower part of the pressure shroud, of the low pressure side condenser;

high pressure steam introducing means provided at the low pressure side hot well, for communicating with an inner side of the high pressure side condenser and introducing high pressure steam;

low pressure side condensate introducing means provided at the pressure shroud, for spraying the low pressure side condensate toward the low pressure side hot well; and a flash box which flashes a heater drain from a feed water heater to generate flash steam, and introduces the generated flash steam into a lower side of the pressure shroud, in an interval between the low pressure side cooling tube bank and the low pressure side hot well.

2. The condenser according to claim 1, wherein the flash box has a heater drain path which has one end connected to a connection port for introducing the heater drain and the other end communicating with at least one of the high pressure side condensate and the low pressure side condensate stored in at least one of the high pressure side hot well and the low pressure side hot well.

3. The condenser according to claim 2, wherein the heater drain path has a drain fall part which communicates with at least one of the high pressure side hot well and the low pressure side hot well.

4. The condenser according to claim 3, wherein the heater drain path is formed in a reverse concave shape, and has a free liquid level part at a horizontal part between a drain channel part communicating with the connection port and the drain fall part.

5. The condenser according to claim 3, wherein a porous plate is provided at the drain fall part.

6. The condenser according to claim 3, wherein the drain fall part is provided adjacent to a flash steam path of the flash box, and a steam outlet for supplying flash steam to the flash steam path is provided on a wall surface facing the flash steam path.

7. A condenser comprising:

a cooling tube bank provided inside the condenser, which has cooling water introduced therein and condenses turbine exhaust by heat exchange with the cooling water to obtain condensate;

a pressure shroud provided at a lower part than the cooling tube bank;

a hot well provided at a lower part of the pressure shroud of the condenser; and a flash box which flashes a heater drain from a feed water heater to generate flash steam, and introduces the generated flash steam into a lower side of the pressure shroud, in an interval between the cooling tube bank and the hot well.

8. The condenser according to claim 7, wherein the flash box has a heater drain path which has one end connected to a connection port for introducing the heater drain and the other end communicating with condensate stored in the hot well.

9. The condenser according to claim 8, wherein the heater drain path has a drain fall part which communicates with the hot well.

10. The condenser according to claim 9, wherein the heater drain path is formed in a reverse concave shape, and has a free liquid level part at a horizontal part between a drain channel part communicating with the connection port and the drain fall part.

11. The condenser according to claim 9, wherein a porous plate is provided at the drain fall part.

12. The condenser according to claim 9, wherein the drain fall part is provided adjacent to a flash steam path of the flash box, and a steam outlet for supplying flash steam to the flash steam path is provided on a wall surface facing the flash steam path.

13. A condenser comprising:

a high pressure side condenser;

a high pressure side cooling tube bank provided inside the high pressure side condenser, which has high pressure side cooling water introduced therein and condenses high pressure side turbine exhaust by heat exchange with the high pressure side cooling water to obtain high pressure side condensate;

a high pressure side hot well provided at a bottom portion of the high pressure side condenser;

a low pressure side condenser which has an inner pressure lower than the high pressure side condenser;

a low pressure side cooling tube bank provided inside the low pressure side condenser, which has low pressure side cooling water introduced therein and condenses low pressure side turbine exhaust by heat exchange with the low pressure side cooling water to obtain low pressure side condensate;

a pressure shroud provided at a lower part than the low pressure side cooling tube bank, inside the low pressure side condenser;

a low pressure side hot well provided at a lower part of the pressure shroud, of the low pressure side condenser;

high pressure steam introducing means provided at the low pressure side hot well, for communicating with an inner side of the high pressure side condenser and introducing high pressure steam;

low pressure side condensate introducing means provided at the pressure shroud, for spraying the low pressure side condensate toward the low pressure side hot well; and a flash box which flashes a heater drain from a feed water heater to generate flash steam, and causes the generated flash steam to contact the low pressure side condensate sprayed from the pressure shroud in an interval between the low pressure side cooling tube bank and the low pressure side hot well.

14. A condenser comprising:

a cooling tube bank provided inside the condenser, which has cooling water introduced therein and condenses turbine exhaust by heat exchange with the cooling water to obtain condensate;

a pressure shroud provided at a lower part than the cooling tube bank;

a hot well provided at a lower part of the pressure shroud, of the condenser;

a flash box which flashes a heater drain from a feed water heater to generate flash steam, and causes the generated flash steam to contact condensate sprayed from the pressure shroud in an interval between the cooling tube bank and the hot well.

15. A condenser comprising:

a high pressure side condenser;

a high pressure side cooling tube bank provided inside the high pressure side condenser, which has high pressure side cooling water introduced therein and condenses high pressure side turbine exhaust by heat exchange with the high pressure side cooling water to obtain high pressure side condensate;

a low pressure side condenser which has an inner pressure lower than the high pressure side condenser;

a low pressure side cooling tube bank provided inside the low pressure side condenser, which has low pressure side cooling water introduced therein and condenses low pressure side turbine exhaust by heat exchange with the low pressure side cooling water to obtain low pressure side condensate;

a pressure shroud provided at a lower part than the low pressure side cooling tube bank, inside the low pressure side condenser;

high pressure steam introducing means for communicating with an inner side of the high pressure side condenser and introducing high pressure steam;

low pressure side condensate introducing means provided at the pressure shroud, for spraying the low pressure side condensate; and a flash box which flashes a heater drain from a feed water heater to generate flash steam, and introduces the generated flash steam into a lower side of the pressure shroud.

16. The condenser according to claim 15, wherein the flash box has a heater drain path which has one end connected to a connection port for introducing the heater drain and the other end communicating with at least one of the high pressure side condensate and the low pressure side condensate stored in at least one of a high pressure side hot well and a low pressure side hot well.

17. The condenser according to claim 16, wherein the heater drain path has a drain fall part which communicates with at least one of the high pressure side hot well and the low pressure side hot well.

18. The condenser according to claim 17, wherein the heater drain path is formed in a reverse concave shape, and has a free liquid level part at a horizontal part between a drain channel part communicating with the connection port and the drain fall part.

19. The condenser according to claim 17, wherein a porous plate is provided at the drain fall part.

20. The condenser according to claim 17, wherein the drain fall part is provided adjacent to a flash steam path of the flash box, and a steam outlet for supplying flash steam to the flash steam path is provided on a wall surface facing the flash steam path.

21. A condenser comprising:

a cooling tube bank provided inside the condenser, which has cooling water introduced therein and condenses turbine exhaust by heat exchange with the cooling water to obtain condensate;

a pressure shroud provided at a lower part than the cooling tube bank;

a flash box which flashes a heater drain from a feed water heater to generate flash steam, and introduces the generated flash steam into a lower side of the pressure shroud.

22. The condenser according to claim 21, wherein the flash box has a heater drain path which has one end connected to a connection port for introducing the heater drain and the other end communicating with condensate stored in a hot well.

23. The condenser according to claim 22, wherein the heater drain path has a drain fall part which communicates with a hot well.

24. The condenser according to claim 23, wherein the heater drain path is formed in a reverse concave shape, and has a free liquid level part at a horizontal part between a drain channel part communicating with the connection port and the drain fall part.

25. The condenser according to claim 23, wherein a porous plate is provided at the drain fall part.

26. The condenser according to claim 23, wherein the drain fall part is provided adjacent to a flash steam path of the flash box, and a steam outlet for supplying flash steam to the flash steam path is provided on a wall surface facing the flash steam path.

27. A condenser comprising:

a high pressure side condenser;

a high pressure side cooling tube bank provided inside the high pressure side condenser, which has high pressure side cooling water introduced therein and condenses high pressure side turbine exhaust by heat exchange with the high pressure side cooling water to obtain high pressure side condensate;

a low pressure side condenser which has an inner pressure lower than the high pressure side condenser;

a low pressure side cooling tube bank provided inside the low pressure side condenser, which has low pressure side cooling water introduced therein and condenses low pressure side turbine exhaust by heat exchange with the low pressure side cooling water to obtain low pressure side condensate;

a pressure shroud provided at a lower part than the low pressure side cooling tube bank, inside the low pressure side condenser;

high pressure steam introducing means for communicating with an inner side of the high pressure side condenser and introducing high pressure steam;

low pressure side condensate introducing means provided at the pressure shroud, for spraying the low pressure side condensate; and a flash box which flashes a heater drain from a feed water heater to generate flash steam, and introduces the generated flash steam to contact the low pressure side condensate sprayed from the pressure shroud.

28. A condenser comprising:

a cooling tube bank provided inside the condenser, which has cooling water introduced therein and condenses turbine exhaust by heat exchange with the cooling water to obtain condensate;

a pressure shroud provided at a lower part than the cooling tube bank; and a flash box which flashes a heater drain from a feed water heater to generate flash steam, and introduces the generated flash steam to contact condensate sprayed from the pressure shroud.

* * * * *